US012247767B2

(12) United States Patent
Xiang et al.

(10) Patent No.: US 12,247,767 B2
(45) Date of Patent: Mar. 11, 2025

(54) ECONOMIZER AND AIR CONDITIONING SYSTEM

(71) Applicant: Carrier Corporation, Palm Beach Gardens, FL (US)

(72) Inventors: Liang Xiang, Shanghai (CN); Fei Xie, Shanghai (CN); Weijie Shao, Shanghai (CN); Lihui Yang, Shanghai (CN); Yifeng Wang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 128 days.

(21) Appl. No.: 17/725,078

(22) Filed: Apr. 20, 2022

(65) Prior Publication Data

US 2022/0333829 A1 Oct. 20, 2022

(30) Foreign Application Priority Data

Apr. 20, 2021 (CN) ..... 202110423066.1

(51) Int. Cl.
*F25B 1/10* (2006.01)
*F25B 40/00* (2006.01)

(52) U.S. Cl.
CPC ..... *F25B 1/10* (2013.01); *F25B 40/00* (2013.01); *F25B 2400/13* (2013.01)

(58) Field of Classification Search
CPC ..... F25B 1/10; F25B 40/00; F25B 2400/13; F25B 2400/16; F25B 2400/23; F25B 2400/03; F25B 43/006; F25B 2313/001
See application file for complete search history.

(56) References Cited

U.S. PATENT DOCUMENTS 9,874,382 B2 * 1/2018 Ali ..... F25B 31/004
2010/0154467 A1 * 6/2010 Fujimoto ..... F25B 1/10 62/512

(Continued)

FOREIGN PATENT DOCUMENTS

CN 107388652 A 11/2017
CN 107421179 A * 12/2017 ..... F25B 43/00

(Continued)

OTHER PUBLICATIONS

European Search Report for Application No. 22169100.9; Issued Aug. 23, 2022; 8 Pages.

(Continued)

*Primary Examiner* — Miguel A Diaz
(74) *Attorney, Agent, or Firm* — CANTOR COLBURN LLP

(57) ABSTRACT

An economizer and an air conditioning system. The economizer includes a housing with a refrigerant inlet for connecting to a first heat exchanger, a refrigerant outlet for connecting to a second heat exchanger, and a suction port for connecting to an intermediate stage of a compressor provided thereon; and a choke portion configured to protrude inwardly from an inner wall of the housing and arranged close to the suction port, such that refrigerant flowing to the suction port is at least partially obstructed. According to the technical solutions of the present application, the refrigerant flowing to the suction port can be at least partially obstructed. When the liquid droplets carried by the refrigerant are obstructed by the choke portion, the liquid droplets are adsorbed on the wall surface to form a liquid film, and the movement of the liquid film is obstructed by the choke portion.

10 Claims, 2 Drawing Sheets

(56) References Cited

U.S. PATENT DOCUMENTS

| | | | | |
|---|---|---|---|---|
| 2011/0139794 | A1* | 6/2011 | Pham | F25B 47/025 220/565 |
| 2015/0096315 | A1* | 4/2015 | Li | F25B 43/00 62/509 |
| 2018/0363962 | A1* | 12/2018 | Ding | F25B 43/00 |

FOREIGN PATENT DOCUMENTS

| | | | | |
|---|---|---|---|---|
| EP | 4105576 | A1 * | 12/2022 | F25B 43/00 |
| JP | H09250848 | A | 9/1997 | |
| JP | 2000320933 | A | 11/2000 | |

OTHER PUBLICATIONS

European Search Report for Application No. 22169100.9; Issued Jan. 11, 2024, 5 Pages.

* cited by examiner

ECONOMIZER AND AIR CONDITIONING SYSTEM

FOREIGN PRIORITY

This application claims priority to Chinese Patent Application No. 202110423066.1, filed Apr. 20, 2021, and all the benefits accruing therefrom under 35 U.S.C. § 119, the contents of which in its entirety are herein incorporated by reference.

FIELD OF THE INVENTION

The present invention relates to the field of air conditioning, in particular to an economizer and an air conditioning system having the same.

BACKGROUND OF THE INVENTION

At present, refrigeration systems and associated equipment have been widely used in various temperature control fields including household air conditioning, commercial air conditioning, cold chain transportation, and cryogenic storage. Among them, large refrigeration equipment is usually used for application scenarios with low evaporating temperature and large cooling capacity demand, such as refrigeration and low-temperature environmental laboratories. An economizer is a commonly used component in large refrigeration systems. It is used to make a part of the refrigerant itself throttle and evaporate to absorb heat, so that the other part of the refrigerant is supercooled, that is, the liquid-phase refrigerant and the gas-phase refrigerant flowing through the economizer are made to be fully separated from each other. In many cases, an economizer can be used in refrigeration systems with multistage compressor units. Under the working condition of low evaporating temperature, ordinary multistage compressor units have many defects such as reduced efficiency, reduced cooling capacity and high exhaust gas temperature. If an economizer is used to supplement air between the compression stages of the multistage compressor unit, the efficiency of the refrigeration cycle can be improved, the cooling capacity can be increased, and the exhaust gas temperature of the compressor can be reduced.

An economizer is a component for improving the energy efficiency of an air conditioning system. It has become a research direction for the modification of the economizer to further improve its reliability or efficiency from various aspect. Taking large refrigeration equipment as an example, the economizer thereof often faces the liquid carryover (LCO) problem when it is working. If the number of liquid droplets carried by the gas-phase refrigerant is small, it will not affect the compressor, and even help the compressor work, such as absorbing part of the vibration energy to help reduce vibration. However, excess liquid droplets may cause corrosion problems in components within the compressor, and may absorb too much compression energy and thus affects system efficiency, which are not desirable.

SUMMARY OF THE INVENTION

The present invention aims to provide an economizer and an air conditioning system, so as to at least partially solve or alleviate the problems existing in the prior art.

In order to achieve at least one objective of the present application, according to one aspect of the present application, an economizer is provided, which comprises: a housing with a refrigerant inlet for connecting to a first heat exchanger, a refrigerant outlet for connecting to a second heat exchanger, and a suction port for connecting to an intermediate stage of a compressor provided thereon; and a choke portion configured to protrude inwardly from the inner wall of the housing and arranged close to the suction port, such that refrigerant flowing to the suction port is at least partially obstructed.

In addition to, or as an alternative to, one or more of the above features, in another embodiment, the housing comprises a first cylindrical housing section and a second cylindrical housing section arranged in a staggered manner in an axial direction and having an interconnecting intermediate connection port; wherein, the refrigerant inlet and the suction port are arranged in the first cylindrical housing section, and the refrigerant outlet is arranged in the second cylindrical housing section.

In addition to, or as an alternative to, one or more of the above features, in another embodiment, the suction port is arranged close to the intermediate connection port, and at least a portion of the choke portion is arranged between the suction port and the intermediate connection port.

In addition to, or as an alternative to, one or more of the above features, in another embodiment, the refrigerant inlet is arranged at a first end of the first cylindrical housing section away from the second cylindrical housing section, and the opening of the refrigerant inlet faces the end wall of the first end of the first cylindrical housing section.

In addition to, or as an alternative to, one or more of the above features, in another embodiment, at least a portion of the choke portion is configured as an annular protrusion protruding inwardly from the inner wall of the housing in a circumferential direction.

In addition to, or as an alternative to, one or more of the above features, in another embodiment, at least a portion of the choke portion is arranged perpendicular to the axial direction of the inner wall of the housing.

In addition to, or as an alternative to, one or more of the above features, in another embodiment, at least a portion of the choke portion is configured to form an included angle within a range of ±45° with the axial direction of the housing.

In addition to, or as an alternative to, one or more of the above features, in another embodiment, the length of at least a portion of the choke portion protruding inwardly from the inner wall of the housing is not greater than 5% of the diameter of the housing.

In addition to, or as an alternative to, one or more of the above features, in another embodiment, at least a portion of the choke portion is arranged between the suction port and the refrigerant inlet.

In order to achieve at least one objective of the present application, according to another aspect of the present application, an air conditioning system is provided, which comprises: a multistage compressor having an intermediate stage; a condenser; an evaporator; and the aforementioned economizer; wherein, a refrigerant inlet of the economizer is connected to the condenser, a refrigerant outlet of the economizer is connected to the evaporator, and a suction port of the economizer is connected to the intermediate stage of the multistage compressor.

According to the economizer of the present application, by arranging a choke portion close to the suction port connecting to the intermediate stage of the compressor, on the one hand, the refrigerant flowing from the refrigerant inlet directly to the suction port can be at least partially obstructed, and on the other hand, the refrigerant flowing from the refrigerant inlet that impinges on the inner wall of the economizer housing, resulting in turbulent flow and turning back to the suction port can also be at least partially obstructed. When the liquid droplets carried by the refrigerant are obstructed by the choke portion, the liquid droplets are adsorbed on the wall surface to form a liquid film, and the movement of the liquid film is obstructed by the choke portion. Eventually, larger liquid droplets will fall off from the liquid film to the bottom of the economizer and flows into the second heat exchanger through the refrigerant outlet. As such, the number of liquid droplets that are sucked to the intermediate stage of the compressor through the suction port is reduced, which effectively alleviates the LCO problem, and improves system performance and economizer capability.

DETAILED DESCRIPTION OF EMBODIMENT(S) OF THE INVENTION

The present application will be described in detail below with reference to exemplary embodiments in the accompanying drawings. It should be understood, however, that the present application may be implemented in many different forms, and should not be construed as being limited to the embodiments set forth herein. The embodiments are herein provided to make the disclosure of the present application thorough and complete, and fully convey the concept of the present application to those skilled in the art.

In addition, for any single technical feature described or implied in the embodiments mentioned herein, or any single technical feature shown or implied in individual drawings, the present application still allows for any combination or omission of these technical features (or equivalents thereof) without any technical obstacle, thereby obtaining more other embodiments of the present application that may not be directly mentioned herein.

For the convenience of describing the embodiments mentioned herein, the axial direction and the radial direction are introduced herein as the Reference Coordinate System. This way of describing directions aims to express the structural characteristics of the respective components and the relative positional relationships between the components, rather than restricting the absolute positional relationships thereof. Taking the housing of the economizer in FIG. 1 as an example, the axial direction refers to the direction indicating the axis of the cylindrical housing, or the direction in which the length of the cylindrical housing extends, and the radial direction refers to the indicated direction of the cylindrical housing that is perpendicular to the axis, or the direction in which the radius of the cylindrical housing extends. In order to more clearly indicate the positional relationships, in some drawings, the X axis is used to indicate the axial direction, and more specifically, X1 and X2 are respectively used to indicate the axes of different sections of the cylindrical housing; in addition, the Y axis is used to indicate the radial direction.

Figure 1:
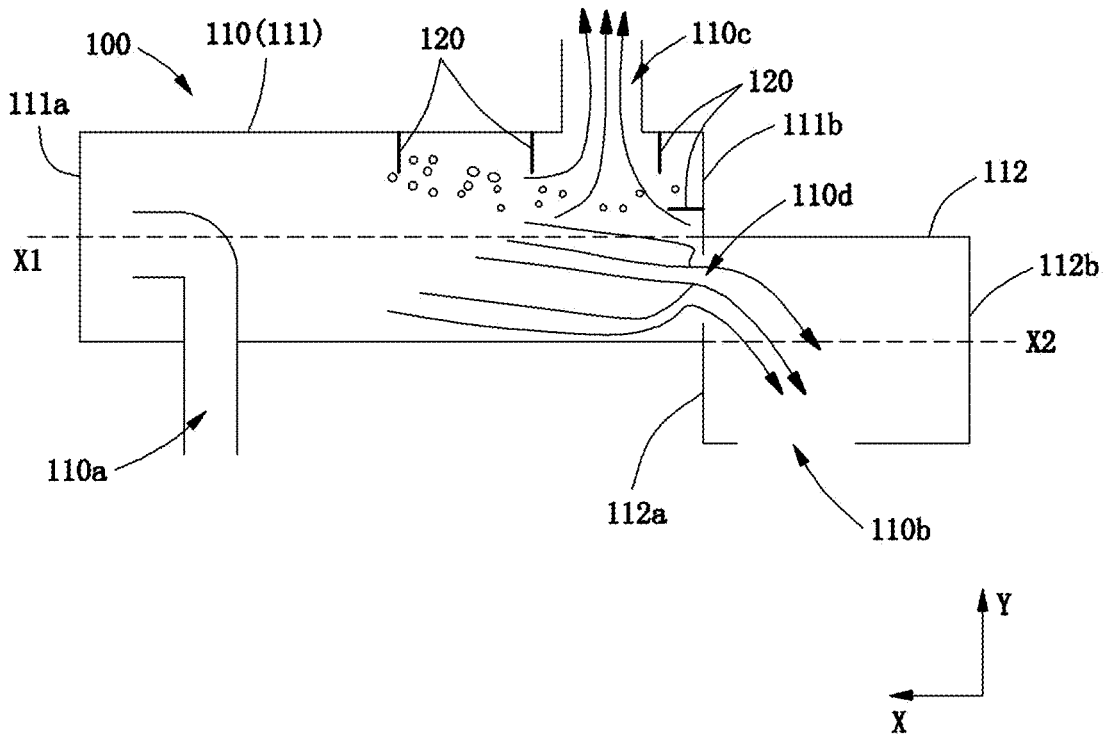
FIG. 1 is a schematic diagram of an embodiment of the economizer of the present application.
Figure 2:
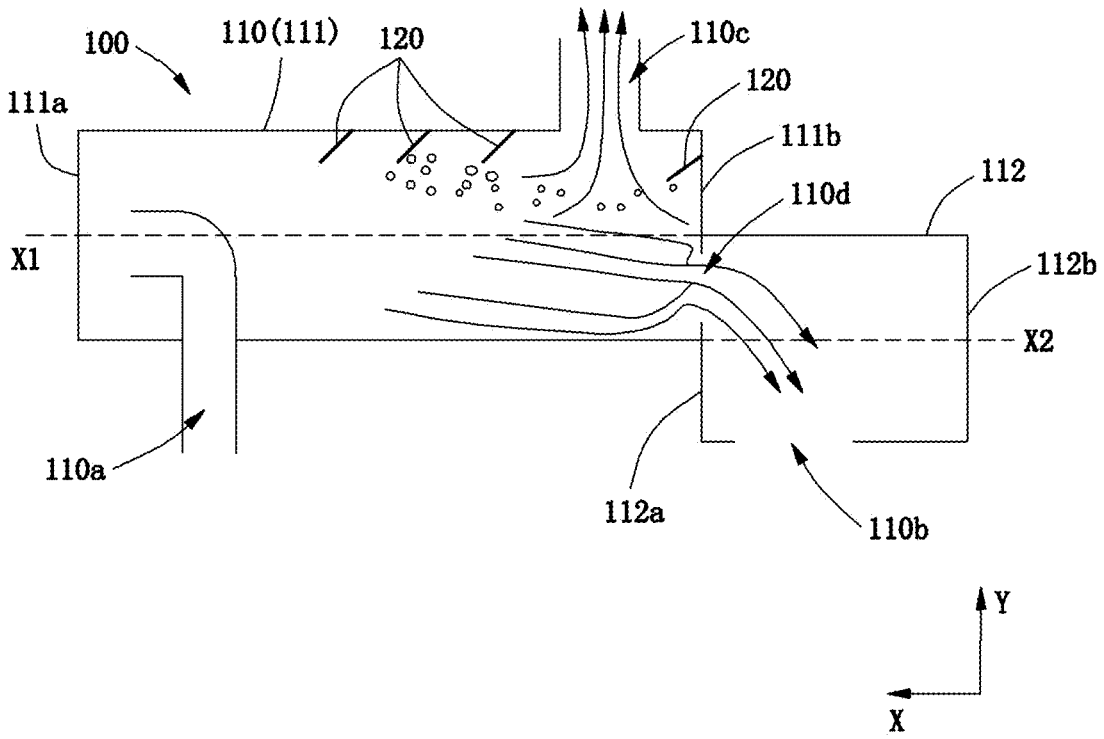
FIG. 2 is a schematic diagram of another embodiment of the economizer of the present application.
Figure 3:
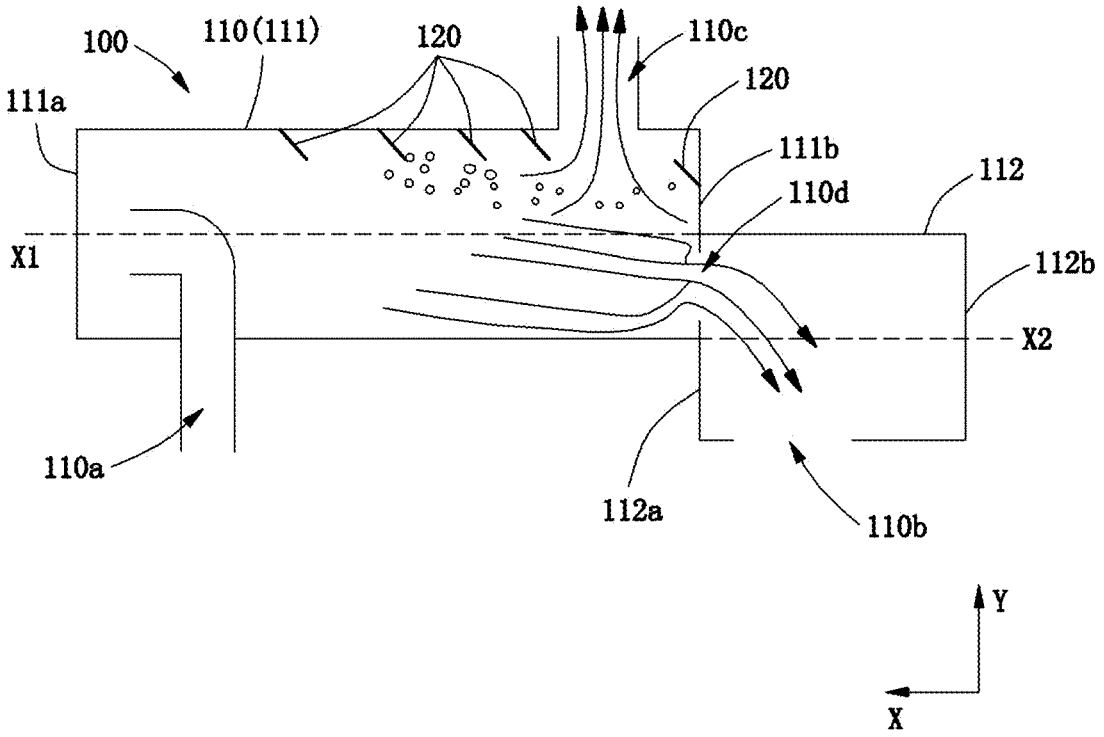
FIG. 3 is a schematic diagram of yet another embodiment of the economizer of the present application.

Referring to FIGS. 1 to 3, various embodiments of the economizer according to the present application are shown. Most of the arrangements of the economizers in these embodiments are similar, the differences being mainly in the specific implementations of the choke portion. The common characteristics of these embodiments of the economizers will first be introduced below, and then the unique characteristics thereof will be described with reference to different figures.

Referring first to FIG. 1, an economizer 100 comprises a housing 110 with a refrigerant inlet 110*a*, a refrigerant outlet 110*b* and a suction port 110*c* provided thereon, respectively. Wherein, the refrigerant inlet 110*a* is used to connect to a first heat exchanger that usually serves as a condenser, so that the two-phase refrigerant from the condenser that is flash evaporated through the high-side throttle valve is introduced into the economizer 100. The introduced two-phase refrigerant undergoes gas-liquid separation in the economizer. After that, the refrigerant mainly in the liquid phase will flow into a second heat exchanger that usually serves as an evaporator through the refrigerant outlet 110*b*, so as to perform its evaporation and heat absorption function; and the refrigerant mainly in the gas phase flows into an intermediate stage of a multistage compressor through the suction port 110*c*, so as to supplement gas and add enthalpy.

In addition, the housing 110 is also provided with a choke portion 120 configured to protrude inwardly from the inner wall of the housing 110 and arranged close to the suction port 110*c*, such that the refrigerant flowing to the suction port 110*c* is at least partially obstructed. Under this arrangement, the economizer according to the present application enables, on the one hand, the refrigerant flowing from the refrigerant inlet directly to the suction port to be at least partially obstructed, and enables, on the other hand, the refrigerant flowing from the refrigerant inlet that impinges on the inner wall of the economizer housing, resulting in turbulent flow and turning back to the suction port to also be at least partially obstructed. When the liquid droplets carried by the refrigerant are obstructed by the choke portion, the liquid droplets are adsorbed on the wall surface to form a liquid film, and the movement of the liquid film is obstructed by the choke portion. Eventually, larger liquid droplets will fall off from the liquid film to the bottom of the economizer and flows into the second heat exchanger through the refrigerant outlet. As such, the number of liquid droplets that are sucked to the intermediate stage of the compressor through the suction port is reduced, which effectively alleviates the LCO problem, and improves system performance and economizer capability.

It should be noted that, regarding the expression "close to" mentioned above, it is intended to express the relative positional relationships between the components, while the specific positional definition should further be summarized according to the purpose of setting the features. For example, in the above context, the choke portion 120 is arranged close to the suction port 110*c*, which means that compared with the refrigerant inlet 110*a* or the refrigerant outlet 110*b*, the choke portion 120 is arranged closer to the suction port 110*c* on the inner wall of the housing, thereby achieving its purpose of influencing the number of liquid droplets carried in the gas-phase refrigerant flowing into the suction port 110*c*.

Further modifications to the economizer will be introduced below by way of examples, so as to further improve its working efficiency, reliability, or for other improvements.

For example, with continued reference to FIG. 1, in one embodiment, the housing 110 of the economizer 100 is configured to comprise a first cylindrical housing section 111 and a second cylindrical housing section 112. The first cylindrical housing section 111 has a first end 111*a* located on the left side in the figure and a second end 111*b* located on the right side in the figure, and the second cylindrical housing section 112 has a first end 112*a* located on the left side in the figure and a second end 112*b* located on the right side in the figure. Wherein, the first cylindrical housing section 111 and the second cylindrical housing section 112 are arranged in a staggered manner in the axial direction X, that is, the axis X1 of the first cylindrical housing section 111 and the axis X2 of the second cylindrical housing section 112 are parallel to each other in the axial direction X and are offset from each other. The second end 111*b* of the first cylindrical housing section 111 is arranged adjacent to the first end 112*a* of the second cylindrical housing section 112, and an intermediate connection port 110*d* is provided therebetween for communicating with the two. The port usually has a shape similar to an "eye", so it is also called an "eye hole". Wherein, the refrigerant inlet 110*a* is provided at the bottom of and within the first cylindrical housing section 111, the suction port 110*c* is provided at the top of and within the first cylindrical housing section 111, and the refrigerant outlet 110*b* is provided at the bottom of and within the second cylindrical housing section 112. After the refrigerant flows into the first cylindrical housing section 111 through the refrigerant inlet 110*a*, a part of the gas-phase refrigerant flows into the compressor through the suction port 110*c*, and the other part of the liquid-phase refrigerant flows into the second cylindrical housing section 112 through the eye hole 110*d* and then flows into an evaporator that is not shown through the refrigerant outlet 110*b*.

For the configuration of the economizer 100 in the aforementioned embodiment, the suction port 110*c* thereof may be arranged close to the intermediate connection port 110*d*, and at least a portion of the choke portion 120 may be arranged between the suction port 110*c* and the intermediate connection port 110*d*. This is because, when the refrigerant flows from the first cylindrical housing section 111 to the second cylindrical housing section 112 through the intermediate connection port 110*d*, its flow area is reduced from a larger cross section of a cylinder to a smaller cross section of an eye hole, so the refrigerant will be partially obstructed and impacted, and then turbulent flow may occur and return to the first cylindrical housing section 111. At this time, a part of the gas-phase refrigerant will also be sucked into the suction port 110*c*. Therefore, by arranging the choke portion 120 between the two ports, the part of returned gas-phase refrigerant can be effectively obstructed, so that the liquid droplets carried with it form a liquid film and eventually form large liquid droplets that fall off from the liquid film. As such, the number of liquid droplets sucked to the intermediate stage of the compressor is reduced, which further effectively alleviate the LCO problem, and improve the system performance and economizer capability.

Based on similar considerations, at least a portion of the choke portion 120 may also be arranged between the suction port 110*c* and the refrigerant inlet 110*a*, which can also effectively obstruct the gas-phase refrigerant flowing therethrough, so that the liquid droplets carried therewith will form a liquid film and eventually form large liquid droplets that fall off from the liquid film, thereby effectively alleviating the LCO problem.

For the configuration of the economizer 100 in the aforementioned embodiment, the refrigerant inlet 110*a* thereof may also be arranged at the first end 111*a* of the first cylindrical housing section 111 away from the second cylindrical housing section 112, and the opening of the refrigerant inlet 110*a* faces the end wall of the first end 111*a* of the first cylindrical housing section 111. Under this arrangement, the liquid-phase refrigerant flowing in through the refrigerant inlet 110*a* will first impinge on the end wall at a high speed, and then form a liquid film state, moving from left to right. When the liquid film encounters the choke portion, it is easier to form large droplets that fall off from the liquid film, which also helps to alleviate the LCO problem.

Various design modifications focusing on the choke portion 120 will be described in detail below with reference to FIGS. 1 to 3.

For example, taking any of the drawings as an example, at least a portion of the choke portion 120 shown in the figure is configured as an annular protrusion protruding inwardly from the inner wall of the housing 110 in the circumferential direction. In a one-piece setting, it has fewer solder joints, is not easy to be corroded, and has stable performance; in a split-type setting, it is easy to manufacture and assemble, and has better applicability as the specific location of the annular protrusion on the housing can be adjusted according to actual needs.

Still taking any of the drawings as an example, wherein, the length of at least a portion of the choke portion 120 protruding inwardly from the inner wall of the housing 110 is not greater than 5% of the diameter of the housing 110. At this time, on the one hand, it can bring a better choking effect and effectively reduce the number of liquid droplets; on the other hand, it will not cause excessive pressure loss to the refrigerant in the economizer, so as to avoid affecting its refrigeration performance.

Taking FIG. 1 as an example, at least a portion of the choke portion 120 may be arranged perpendicular to the axial direction X of the inner wall of the housing 110, which is easier to arrange. Taking FIGS. 2 and 3 as examples, at least a portion of the choke portion 120 may also be arranged to form an included angle within a range of ±45° with the axial direction X of the inner wall of the housing 110. Wherein, when a portion of the choke portion 120 is inclined toward the side to which the refrigerant flows (as shown in FIG. 3), it has a larger choking area; and when a portion of the choke portion 120 is inclined toward the side opposite to the refrigerant flow (as shown in FIG. 2), it can bring a stronger choking effect.

In addition, although not shown in the figures, an embodiment of an air conditioning system according to the present application is further provided herein. The air conditioning system comprises the economizer mentioned in any of the aforementioned embodiments or combinations thereof, and thus also has the corresponding technical effects, which will not be repeated here. Furthermore, for an air conditioning system, it further comprises a multistage compressor having an intermediate stage, a condenser, and an evaporator. Under this arrangement, the refrigerant inlet 110*a* of the economizer 100 will be connected to the condenser, the refrigerant outlet 110*b* of the economizer 100 will be connected to the evaporator, and the suction port 110*c* of the economizer 100 will be connected to the intermediate stage of the multistage compressor, thereby achieving the suction, separation and outflow of the refrigerant.

Wherein, those skilled in the art should understand that the air conditioning system set forth in the present application does not refer to the air conditioner with indoor refrigerating/heating unit and outdoor heat exchange unit used in buildings in the industry in a narrow sense. It, however, should be understood as a type of thermal system with the function of achieving air conditioning, which, when driven by various power sources (e.g., electric power), achieves heat exchange with the air at the location to be conditioned through the phase change of the refrigerant in the system.

For example, when the air conditioning system is used for building HVAC (Heating Ventilation Air Conditioning), it may be a refrigeration system with cooling function only, or it may be a heat pump system with both cooling and heating capabilities. For another example, when the air conditioning system is used in the field of cold chain, it may be a transport refrigeration system or a refrigeration/freezing system. However, no matter what form of air conditioning system it is, there should be an economizer so as to be applicable to the concept of the present application.

A refrigeration system will be taken as an example below to describe the working process of such a refrigeration system having an economizer in any of the aforementioned embodiments or combinations thereof. First, when the work starts, the gas-phase refrigerant discharged from the multi-stage compressor is pressed into the condenser; the gas-phase refrigerant flows in the condenser and exchanges heat with water or other media during the flow; the cooled refrigerant passes through the condenser outlet and flows into the housing 110 from the refrigerant inlet 110*a* at the bottom of the first end 111*a* of the economizer 100, ejecting and impinging on the end wall of the first end 111*a* and forming a liquid film, which flows from left to right in the housing in the longitudinal direction until it hits the choke portion 120 on the upper part of the inner wall of the housing. At this time, a part of the gas-liquid two-phase refrigerant suspended in the upper part of the housing and the liquid film will be adsorbed by the choke portion 120, and eventually form larger liquid droplets that fall off from the liquid film; and the refrigerant gas is sucked into the intermediate stage of the compressor through the suction port 110*c* to achieve gas supplementation and enthalpy addition. On the other hand, when a part of the refrigerant that continues to move forward flows into the second cylindrical housing section 112 through the intermediate connection port 110*d*, due to a sudden reduction of the flow area, a part of the gas-phase refrigerant carrying liquid droplets will form return flows. The returned gas-liquid two-phase refrigerant is also adsorbed by the choke portion 120 and eventually form larger liquid droplets that fall off from the liquid film. The refrigerant gas is sucked into the intermediate stage of the compressor through the suction port 110*c* to achieve gas supplementation and enthalpy addition. In addition, the liquid-phase refrigerant that flows into the second cylindrical housing section 112 will enter the evaporator through the refrigerant outlet 110*b* at the bottom the housing 110 to exchange heat therein before returning to the compressor. The reciprocating cycle of the refrigeration system goes in this way.

The above examples mainly illustrate the economizer and the air conditioning system of the present invention. Although only some of the embodiments of the present invention are described, those skilled in the art should understand that the present invention may, without departing from the spirit and scope thereof, be implemented in many other forms. Therefore, the examples and embodiments illustrated are to be considered as illustrative but not restrictive, and the present invention may cover various modifications or replacements if not departed from the spirit and scope of the present invention as defined by the appended claims.

What is claimed is:

1. An economizer, comprising:

a housing with a refrigerant inlet for connecting to a first heat exchanger, a refrigerant outlet for connecting to a second heat exchanger, and a suction port for connecting to an intermediate stage of a compressor; and a choke portion configured to protrude inwardly from an inner wall of the housing such that refrigerant flowing to the suction port is at least partially obstructed;

wherein the choke portion is arranged closer to the suction port on the inner wall of the housing than to the refrigerant inlet and the choke portion is arranged closer to the suction port on the inner wall of the housing than to the refrigerant outlet;

wherein the choke portion includes a first wall located between the refrigerant inlet and the suction port, the first wall arranged closer to the suction port on the inner wall of the housing than to the refrigerant inlet;

wherein the choke portion includes a second wall located between the refrigerant outlet and the suction port, the second wall arranged closer to the suction port on the inner wall of the housing than to the refrigerant outlet.

2. The economizer according to claim 1, wherein, the housing comprises a first cylindrical housing section and a second cylindrical housing section arranged in a staggered manner in an axial direction and having an interconnecting intermediate connection port; wherein, the refrigerant inlet and the suction port are arranged in the first cylindrical housing section, and the refrigerant outlet is arranged in the second cylindrical housing section.

3. The economizer according to claim 2, wherein, the suction port is arranged closer to the intermediate connection port than to the refrigerant inlet and the suction port is arranged closer to the intermediate connection port than to the refrigerant outlet, and at least a portion of the choke portion is arranged between the suction port and the intermediate connection port.

4. The economizer according to claim 2, wherein, the refrigerant inlet is arranged at a first end of the first cylindrical housing section away from the second cylindrical housing section, and an opening of the refrigerant inlet faces an end wall of the first end of the first cylindrical housing section.

5. The economizer according to claim 1, wherein, at least a portion of the choke portion is configured as an annular protrusion protruding inwardly from an inner wall of the housing in a circumferential direction.

6. The economizer according to claim 1, wherein, at least a portion of the choke portion is arranged perpendicular to an axial direction of the inner wall of the housing.

7. The economizer according to claim 1, wherein, at least a portion of the choke portion is arranged to form an included angle within a range of ±45° with the axial direction of the housing.

8. The economizer according to claim 1, wherein, a length of at least a portion of the choke portion protruding inwardly from the inner wall of the housing is not greater than 5% of a diameter of the housing.

9. The economizer according to claim 1, wherein, at least a portion of the choke portion is arranged between the suction port and the refrigerant inlet.

10. An air conditioning system, comprising:

the economizer of claim 1;

the first heat exchanger comprising a condenser;

the second heat exchanger comprising an evaporator; and wherein, the refrigerant inlet of the economizer is connected to the condenser, the refrigerant outlet of the economizer is connected to the evaporator, and the suction port of the economizer is connected to the intermediate stage of the compressor.

* * * * *